US007360324B2

(12) United States Patent
Aveni

(10) Patent No.: US 7,360,324 B2
(45) Date of Patent: Apr. 22, 2008

(54) ARTICLE OF FOOTWEAR WITH SPHERICAL SUPPORT ELEMENTS

(75) Inventor: Michael A. Aveni, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 309 days.

(21) Appl. No.: 11/205,280

(22) Filed: Aug. 15, 2005

(65) Prior Publication Data

US 2007/0033831 A1 Feb. 15, 2007

(51) Int. Cl.
*A43B 13/18* (2006.01)

(52) U.S. Cl. ..... 36/27; 36/28; 36/35 R

(58) Field of Classification Search ..... 36/27, 36/28, 35 R, 29, 35 B
See application file for complete search history.

(56) References Cited

U.S. PATENT DOCUMENTS 2,423,753 A * 7/1947 Brooks ..... 36/35 R
5,461,800 A 10/1995 Luthi et al.
5,853,844 A * 12/1998 Wen ..... 428/119
6,266,897 B1 7/2001 Seydel et al.
6,516,540 B2 2/2003 Seydel et al.
6,530,564 B1 3/2003 Julien
6,568,102 B1 * 5/2003 Healy et al. ..... 36/28
7,082,698 B2 * 8/2006 Smaldone et al. ..... 36/28
2004/0128860 A1 7/2004 Smaldone et al.
2004/0154169 A1 8/2004 Wang
2007/0033831 A1 * 2/2007 Aveni ..... 36/28

FOREIGN PATENT DOCUMENTS

WO 03079840 A1 10/2003
WO 036721 A2 4/2005

OTHER PUBLICATIONS

International Search Report From PCT/US2006/031875.

* cited by examiner

*Primary Examiner*—Ted Kavanaugh
(74) *Attorney, Agent, or Firm*—Banner & Witcoff, Ltd.

(57) ABSTRACT

An article of footwear includes an upper and a sole assembly having an upper plate and a lower plate spaced from the upper plate. At least one spherical support element is positioned between the upper plate and the lower plate. Each spherical element includes an inner spherical member and an outer spherical member, with the inner spherical member being positioned within the outer spherical member.

35 Claims, 2 Drawing Sheets

ARTICLE OF FOOTWEAR WITH SPHERICAL SUPPORT ELEMENTS

FIELD OF THE INVENTION

This invention relates generally to an article of footwear, and, in particular, to an article of footwear having spherical support elements.

BACKGROUND OF THE INVENTION

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities.

It would be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with improved support and cushioning. In accordance with a first aspect, an article of footwear includes an upper and a sole assembly having an upper plate and a lower plate spaced from the upper plate. At least one spherical support element is positioned between the upper plate and the lower plate. Each spherical element includes an inner spherical member and an outer spherical member, with the inner spherical member being positioned within the outer spherical member.

In accordance with another aspect, an article of footwear includes an upper and a midsole secured to the upper. The midsole has a support assembly including an upper plate having a lower surface and a lower plate spaced from the upper plate and having an upper surface. A plurality of spherical support elements is positioned between the lower surface of the upper plate and the upper surface of the lower plate. Each spherical support element includes an inner spherical member having a pair of opposed apertures formed therein, and an outer spherical member having a pair of opposed apertures. The inner spherical member is positioned within the outer spherical member. An outsole is secured to the midsole.

In accordance with a further aspect, an article of footwear includes an upper and a midsole secured to the upper. The midsole has a support assembly including a lower plate having a plurality of raised platforms extending upwardly from an upper surface of the lower plate, with each raised platform having a first recess formed therein. An upper plate is spaced from the lower plate and has a plurality of raised platforms extending downwardly from a lower surface of the upper plate. Each raised platform has a second recess formed therein. A plurality of spherical support elements is positioned between the upper plate and the lower plate. Each spherical support element is seated in a corresponding first recess in the lower plate and a corresponding second recess in the upper plate. Each spherical support element has an inner spherical member with a pair of opposed apertures formed therein. The apertures open in a direction extending substantially parallel to the upper surface of the lower plate and the lower surface of the upper plate. An outer spherical member has a pair of opposed apertures, with the apertures opening in a direction extending substantially perpendicular to the upper surface of the lower plate and the lower surface of the upper plate. The inner spherical member is positioned within the outer spherical member. An outsole is secured to the midsole.

Substantial advantage is achieved by providing an article of footwear with spherical support elements. In particular, certain embodiments create additional support and cushioning for the user's foot, enhancing comfort and performance.

These and additional features and advantages disclosed here will be further understood from the following detailed disclosure of certain embodiments.

Figure 1:
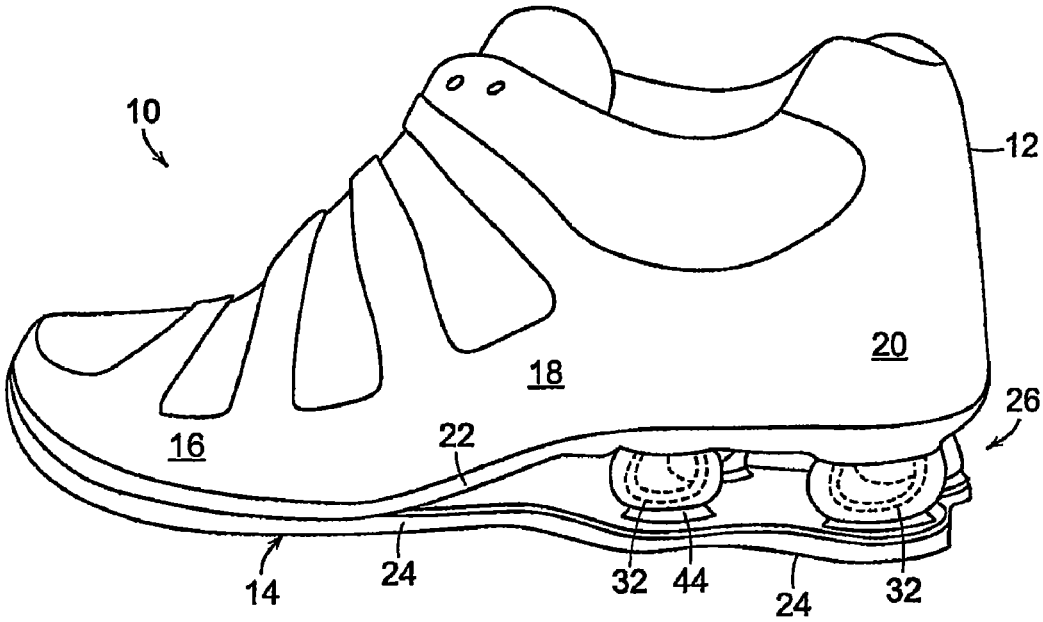
FIG. 1 is a perspective view of an embodiment of an article of footwear.

The figures referred to above are not drawn necessarily to scale and should be understood to provide a representation of the invention, illustrative of the principles involved. Some features of the article of footwear depicted in the drawings have been enlarged or distorted relative to others to facilitate explanation and understanding. The same reference numbers are used in the drawings for similar or identical components and features shown in various alternative embodiments. Articles of footwear as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear 10 is shown in FIG. 1. Footwear 10 includes an upper 12 and a sole assembly 14 secured to upper 12. Sole assembly 14 may be secured to upper 12 by adhesive or any other suitable means.

For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 may include an insole (not shown) located within upper 12, a midsole 22, and an outsole 24. Midsole 22 is attached to upper 12 and functions as the primary shock-attenuating and energy-absorbing component of footwear 10. Outsole 24 is attached to the lower surface of midsole 22 by adhesive or other suitable means. Suitable materials for outsole 24 include polymers, e.g., polyether-block co-polyamide polymers (sold as Pebax® by ATOFINA Chemicals of Philadelphia, Pa.), and nylon resins such as Zytel®, sold by Dupont. Other suitable materials for outsole 24 will become readily apparent to those skilled in the art, given the benefit of this disclosure. In certain embodiments, sole assembly 14 may not include an outsole layer separate from midsole 22 but, rather, the outsole comprises a bottom surface of midsole 22 that provides the external traction surface of sole assembly 14.

Figure 2:
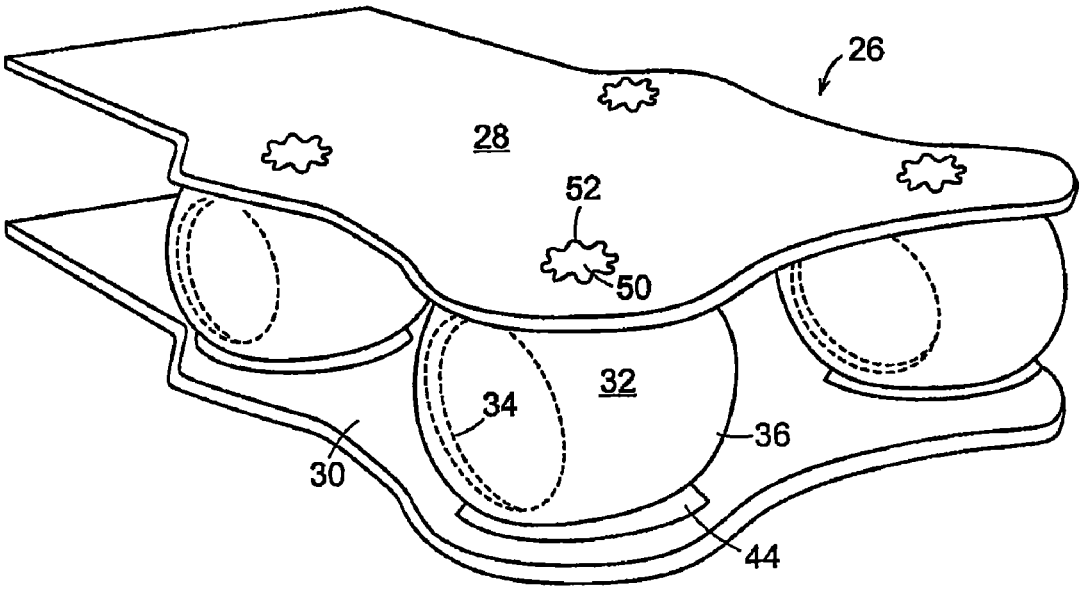
FIG. 2 is a perspective view of a support assembly of the article of footwear of claim 1, showing spherical support elements positioned between an upper plate and a lower plate.
Figure 3:
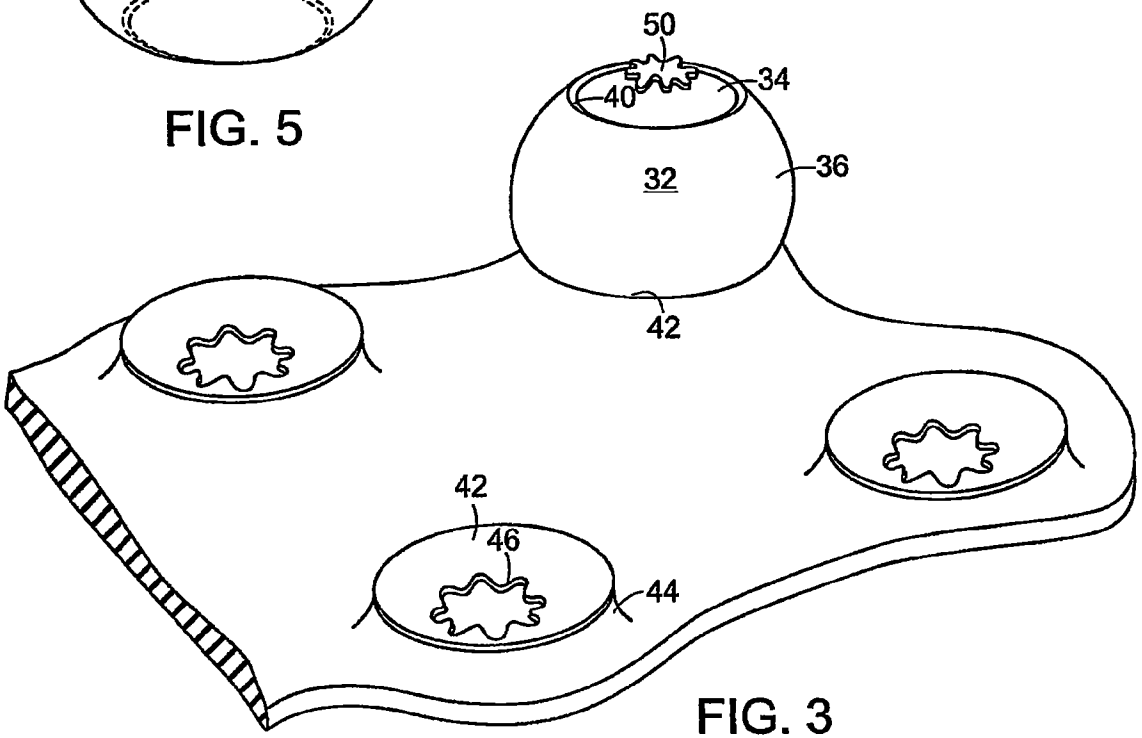
FIG. 3 is a perspective view of a portion of the support assembly of FIG. 2, showing a spherical support element seated in a recess of the lower plate.

Midsole 24 of sole assembly 14 includes a support assembly 26, seen in FIGS. 2-3, which includes an upper plate 28, a lower plate 30, and a plurality of spherical support elements 32 positioned between a lower surface of upper plate 28 and an upper surface of lower plate 30.

Upper plate 28 is secured to upper 12 with adhesive or other suitable means, while lower plate 30 is secured to outsole 24 with adhesive or other suitable means. It is to be appreciated that in certain embodiments, sole assembly 14 may not have an outsole, in which case lower plate 30 could act as the ground-engaging member of footwear 10. Spherical support elements 32 may, in certain embodiments, be secured to upper plate 28 and lower plate 30 with an adhesive.

In the embodiment illustrated in FIG. 1, support assembly 26 is located in heel portion 20. It is to be appreciated that support assembly 26 and its corresponding spherical support elements 32 can be located in any portion of sole assembly 14, including any of forefoot portion 16, midfoot portion 18, heel portion 20, or any combination thereof.

Upper plate 28 and lower plate 30 may be formed of plastic, e.g., a high flex modulus polyether block amide, such as PEBAX®, which is manufactured by the Atofina Company, or a reinforced plastic. In other embodiments, a glass reinforced nylon may be used. Other suitable materials for upper plate 28 and lower plate 30 will become readily apparent to those skilled in the art, given the benefit of this disclosure.

Figure 4:
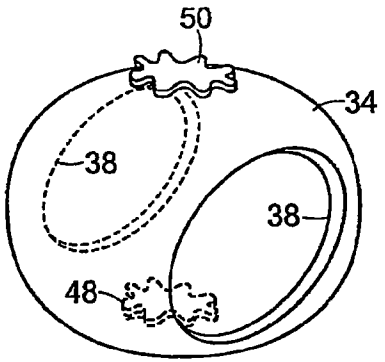
FIG. 4 is a perspective view of an inner spherical member of a spherical support element of FIG. 1.
Figure 5:
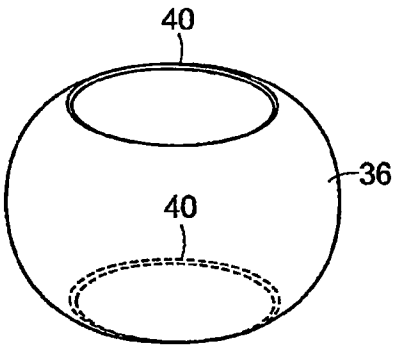
FIG. 5 is a perspective view of an outer spherical member of a spherical support element of FIG. 1.

Spherical support elements 32 are formed of an inner spherical member 34, seen in FIG. 4, and an outer spherical member 36, seen in FIG. 5, which captures a corresponding inner spherical member 34. As seen in FIG. 4, inner spherical member 34 has a pair of opposed apertures 38. Apertures 38 are positioned on the sides of inner spherical member 34, such that they each open in a direction that is substantially parallel to the lower surface of upper plate 28 and the upper surface of lower plate 30. Apertures 38 increase the ability of inner spherical members 34 to flex during compression as well as helping ensure that they compress uniformly.

Inner spherical members 34 may be formed of plastic, e.g., a high flex modulus polyether block amide, such as PEBAX®, which is manufactured by the Atofina Company, or a reinforced plastic such as a glass reinforced nylon. Other suitable materials for inner spherical members 34 will become readily apparent to those skilled in the art, given the benefit of this disclosure.

Outer spherical members 36 have a pair of opposed apertures 40, as seen in FIG. 5, which open in a direction that is substantially perpendicular to the lower surface of upper plate 28 and the upper surface of lower plate 30. Outer spherical members 36 may be formed of, for example, urethane or thermoplastic polyurethane (TPU), such as Desmopan®, which is manufactured by Bayer. Other suitable materials for inner spherical members 34 will become readily apparent to those skilled in the art, given the benefit of this disclosure.

As seen in FIGS. 2-3, inner spherical members 34 are captured within outer spherical members 36, such that outer spherical members 36 are suspended on inner spherical members 34. Outer spherical members 36 provide additional support and cushioning for support assembly 26. Inner spherical members 34 and outer spherical members 36 may be translucent, transparent, or opaque, or any combination thereof, depending on the desired cosmetic appearance of footwear 10. Additionally, spherical members 34 and outer spherical members 36 may be any desired color.

As seen in FIGS. 2-3, each spherical support element 32 is seated in a first recess 42 formed in lower plate 30 and a corresponding second recess (not visible) formed in upper plate 28. In the illustrated embodiment, first recess 42 is formed in a raised platform 44 that extends upwardly from the upper surface of lower plate 30. Each second recess is similarly formed in a raised platform (not visible) that extends downwardly from the lower surface of upper plate 28. In the illustrated embodiment, inner spherical member 34 is in contact with first recess 42 in lower plate 30 and the corresponding second recess in upper plate 28, with the periphery of apertures 40 of outer spherical member 36 extending about the periphery of platform 44. It is to be appreciated that in other embodiments, outer spherical member 36 may contact first recess 42 in lower plate 30 and the corresponding second recess in upper plate 28.

Recesses 42 within raised platforms 44 provide increased surface area for adhering spherical support elements 32 to upper plate 28 and lower plate 30, as well as providing additional stability to resist shear movement. It is to be appreciated that in certain embodiments, the first and second recesses may be formed directly in the surface of lower plate 30 and upper plate 28. As can be seen in FIG. 3, recesses 42 may have a concave shape in order to substantially mate with the exterior surface of inner spherical member 34.

In certain embodiments, as illustrated in FIGS. 2, 4, a first projection 48 is formed on the bottom of each inner spherical member 34 and a second projection 50 is formed on the top of each inner spherical member 34. A first receptacle such as a first aperture 46 is formed within each first recess 42 in lower plate 30, which receives a corresponding first projection 48 of a spherical support element 32, thereby registering spherical support element 32 with respect to lower plate 30. Each second projection 50 is similarly received in a corresponding second receptacle such as a second recess (not visible) formed in upper plate 28, thereby registering spherical support element 32 with respect to upper plate 28. The mating of the projections within the recesses helps ensure that spherical support elements 32 remain properly aligned with upper plate 28 and lower plate 30. It can be seen that first and second projections 48, 50 on inner spherical member 34 extend through the apertures 40 formed in outer spherical member 36.

In another embodiment, as illustrated in FIG. 3, each of first and second projections 48, 50 are received in a corresponding first receptacle having the form of a first aperture (not visible) and a second aperture 52, extending through lower plate 30 and upper plate 28, respectively.

In the illustrated embodiment, first projections 48 and second projections 50, as well as the first receptacles in which they are received, namely, the first and second recesses and first and second apertures, are substantially star-shaped. It is to be appreciated that the projections, recesses and apertures may have any desired shape, and other suitable shapes will become readily apparent to those skilled in the art, given the benefit of this disclosure.

In the embodiment illustrated herein, four spherical support elements 32 are positioned between upper plate 28 and lower plate 30. It is to be appreciated that any number of spherical support elements 32, greater or less than the four illustrated here, can be positioned between upper plate 28 and lower plate 30. The location, as well as the size, of spherical support elements 32 can be varied to provide different levels of support and cushioning for the foot of the user. Specific locations and suitable sizes for spherical support elements 32 will become readily apparent to those skilled in the art, given the benefit of this disclosure.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination;

an upper; and a sole assembly including a support assembly comprising:

an upper plate having a lower surface;

a lower plate spaced from the upper plate and having an upper surface; and at least one spherical support element positioned between the lower surface of the upper plate and the upper surface of the lower plate, each spherical element comprising an inner spherical member and an outer spherical member, the inner spherical member being positioned within the outer spherical member;

wherein the inner spherical member has a pair of opposed apertures formed therein, the outer spherical member has a pair of opposed apertures formed therein, and the outer spherical member covers the apertures of the inner spherical member.

2. The article of footwear of claim 1, wherein the apertures in the inner spherical member open in a direction that extends substantially parallel to the lower surface of the upper plate and the upper surface of the lower plate, and the apertures in the outer spherical member open in a direction that extends substantially perpendicular to the lower surface of the upper plate and the upper surface of the lower plate.

3. The article of footwear of claim 1, wherein the outer spherical member is formed of TPU.

4. The article of footwear of claim 1, wherein the inner spherical member is formed of a polyether block amide.

5. The article of footwear of claim 1, wherein the outer spherical member is substantially translucent.

6. The article of footwear of claim 1, wherein the outer spherical member is substantially transparent.

7. The article of footwear of claim 1, wherein the inner spherical member is adhesively secured to the upper and lower plates.

8. The article of footwear of claim 1, further comprising at least one first recess formed in the upper surface of the lower plate and at least one second recess formed in the lower surface of the upper plate, each first and second recess receiving a portion of a corresponding spherical support element.

9. The article of footwear of claim 8, further comprising:

at least one first receptacle, each first receptacle positioned within a corresponding first recess;

at least one first projection, each first projection formed on a spherical support element and received in a corresponding first receptacle;

at least one second receptacle, each second receptacle positioned within a corresponding second recess; and at least one second projection, each second projection formed on a spherical support element and received in a corresponding second receptacle.

10. The article of footwear of claim 9, wherein the first and second receptacles and first and second projections are substantially star-shaped.

11. The article of footwear of claim 9, wherein at least one first receptacle is a recess formed in the lower plate and at least one second receptacle is a recess formed in the upper plate.

12. The article of footwear of claim 9, wherein at least one first receptacle is an aperture extending through the lower plate and at least one second receptacle is an aperture extending through the upper plate.

13. The article of footwear of claim 9, wherein each spherical support element comprises:

an inner spherical member having a pair of opposed apertures formed therein, each first projection and second projection being formed on an inner spherical member; and an outer spherical member having a pair of opposed apertures, the inner spherical member being positioned within the outer spherical member such that the first and second projections extend through the apertures in the outer spherical member.

14. The article of footwear of claim 13, wherein the apertures in the inner spherical member open in a direction that extends substantially parallel to the lower surface of the upper plate and the upper surface of the lower plate and the apertures in the outer spherical member open in a direction that extends substantially perpendicular to the lower surface of the upper plate and the upper surface of the lower plate.

15. The article of footwear of claim 8, further comprising:

at least one raised platform extending upwardly from the upper surface of the lower plate, each first recess being positioned in a corresponding raised platform of the lower plate; and at least one raised platform extending downwardly from the lower surface of the upper plate, each second recess being positioned in a corresponding raised platform of the upper plate.

16. The article of footwear of claim 8, wherein the first and second recesses have a concave shape.

17. The article of footwear of claim 1, wherein each spherical support element is positioned in a heel portion of the sole assembly.

18. The article of footwear of claim 1, further comprising an outsole secured to the lower plate.

19. An article of footwear comprising, in combination;

an upper;

a midsole secured to the upper and including a support assembly comprising:

an upper plate having a lower surface;

a lower plate spaced from the upper plate and having an upper surface; and a plurality of spherical support elements positioned between the lower surface of the upper plate and the upper surface of the lower plate, each spherical support element comprising:

an inner spherical member having a pair of opposed apertures formed therein; and an outer spherical member having a pair of opposed apertures, the inner spherical member positioned within the outer spherical member, the outer member covering the apertures of the inner spherical member; and an outsole secured to the midsole.

20. The article of footwear of claim 19, further comprising a plurality of first recesses formed in the upper surface of the lower plate and a plurality of second recesses formed in the lower surface of the upper plate, each first and second recess receiving a portion of a corresponding spherical support element.

21. The article of footwear of claim 20, further comprising:

a plurality of first receptacles, each first receptacle positioned within a corresponding first recess;

a plurality of first projections, each first projection formed on a spherical support element and received in a corresponding first receptacle;

a plurality of second receptacles, each second receptacle positioned within a corresponding second recess; and a plurality of second projections, each second projection formed on a spherical support element and received in a corresponding second receptacle.

22. The article of footwear of claim 21, wherein the first and second receptacles and first and second projections are substantially star-shaped.

23. The article of footwear of claim 21, wherein at least one first receptacle is a recess fonned in the lower plate and at least one second receptacle is a recess formed in the upper plate.

24. The article of footwear of claim 21, wherein at least one first receptacle is an aperture extending through the lower plate and at least one second receptacle is an aperture extending through the upper plate.

25. The article of footwear of claim 21, wherein each spherical support element comprises:

an inner spherical member having a pair of opposed apertures formed therein, each first projection and second projection being formed on an inner spherical member; and an outer spherical member having a pair of opposed apertures, the inner spherical member being positioned within the outer spherical member such that the first and second projections extend through the apertures in the outer spherical member.

26. The article of footwear of claim 20, further comprising:

a raised platform extending upwardly from the upper surface of the lower plate, each first recess being positioned in a corresponding raised platform of the lower plate; and a raised platform extending downwardly from the lower surface of the upper plate, each second recess being positioned in a corresponding raised platform of the upper plate.

27. The article of footwear of claim 20, wherein the first and second recesses are concave shaped.

28. The article of footwear of claim 20, wherein the inner spherical members are received in the first and second recesses.

29. The article of footwear of claim 19, wherein the apertures in the inner spherical member open in a direction that extends substantially parallel to the lower surface of the upper plate and the upper surface of the lower plate, and the apertures in the outer spherical member open in a direction that extends substantially perpendicular to the lower surface of the upper plate and the upper surface of the lower plate.

30. An article of footwear comprising, in combination;

an upper;

a midsole secured to the upper and including a support assembly comprising:

a lower plate having a plurality of raised platforms extending upwardly from an upper surface of the lower plate, each raised platform having a first recess formed therein;

an upper plate spaced from the lower plate and having a plurality of raised platforms extending downwardly from a lower surface of the upper plate, each raised platform having a second recess formed therein; and a plurality of spherical support elements positioned between the upper plate and the lower plate, each spherical support element seated in a corresponding first recess in the lower plate and a corresponding second recess in the upper plate and comprising:

an inner spherical member having a pair of opposed apertures formed therein, the apertures opening in a direction extending substantially parallel to the upper surface of the lower plate and the lower surface of the upper plate; and an outer spherical member having a pair of opposed apertures, the apertures opening in a direction extending substantially perpendicular to the upper surface of the lower plate and the lower surface of the upper plate, the inner spherical member positioned within the outer spherical member; and an outsole secured to the midsole.

31. The article of footwear of claim 30, further comprising:

a plurality of first receptacles, each first receptacle positioned within a corresponding first recess;

a plurality of first projections, each first projection formed on a spherical support element and received in a corresponding first receptacle;

a plurality of second receptacles, each second receptacle positioned within a corresponding second recess; and a plurality of second projections, each second projection formed on a spherical support element and received in a corresponding second receptacle.

32. The article of footwear of claim 31, wherein the first and second receptacles and first and second projections are substantially star-shaped.

33. The article of footwear of claim 31, wherein at least one first receptacle and at least one second receptacle is a recess formed in the lower plate.

34. The article of footwear of claim 31, wherein at least one first receptacle and at least one second receptacle is an aperture extending through the lower plate.

35. The article of footwear of claim 30, wherein the inner spherical members are received in the first and second recesses.

* * * * *

UNITED STATES PATENT AND TRADEMARK OFFICE

CERTIFICATE OF CORRECTION

PATENT NO. : 7,360,324 B2
APPLICATION NO. : 11/205280
DATED : April 22, 2008
INVENTOR(S) : Michael A. Aveni It is certified that error appears in the above-identified patent and that said Letters Patent is hereby corrected as shown below:

Column 8, line 2, replace “fonned” with --formed--.

Signed and Sealed this

Fifteenth Day of July, 2008

JON W. DUDAS
*Director of the United States Patent and Trademark Office*